United States Patent [19]

Fayal et al.

[11] 4,299,111

[45] Nov. 10, 1981

[54] MOLDING OF SUPERPLASTIC METALS

[75] Inventors: James E. Fayal, Stonington, Conn.; Joseph A. Morrone, III, North Kingston, R.I.

[73] Assignee: Greene Plastics Corporation, Hope Vallen, R.I.

[21] Appl. No.: 45,306

[22] Filed: Jun. 4, 1979

[51] Int. Cl.[3] ..... B21D 37/16

[52] U.S. Cl. ..... 72/342; 72/354; 72/356; 72/364; 148/11.5 R

[58] Field of Search ..... 148/11.5 R, 11.5 A; 72/353, 354, 342, 364, 352, 357, 356

[56] References Cited

U.S. PATENT DOCUMENTS

| | | | |
|---|---|---|---|
| 3,578,511 | 5/1971 | Mehl et al. | 148/11.5 R |
| 3,920,175 | 11/1975 | Hamilton et al. | 228/173 |
| 3,927,817 | 12/1975 | Hamilton et al. | 228/157 |
| 3,934,441 | 1/1976 | Hamilton et al. | 72/60 |
| 3,974,673 | 8/1976 | Fosness | 72/342 X |
| 4,023,389 | 5/1977 | Dibble et al. | 72/364 X |
| 4,048,836 | 7/1977 | Eddy et al. | 148/11.5 A |

*Primary Examiner*—Leon Gilden

*Attorney, Agent, or Firm*—Robert A. Cesari; John F. McKenna; Andrew Kehoe

[57] ABSTRACT

A novel process for molding articles from superplastic metals. The process is characterized by a fast-cycle utilizing a cooling and high-speed reject steps.

5 Claims, 10 Drawing Figures

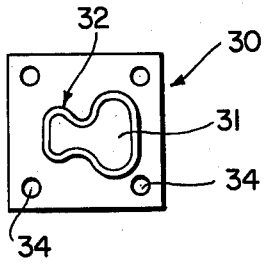
Fig. 1
Fig. 2
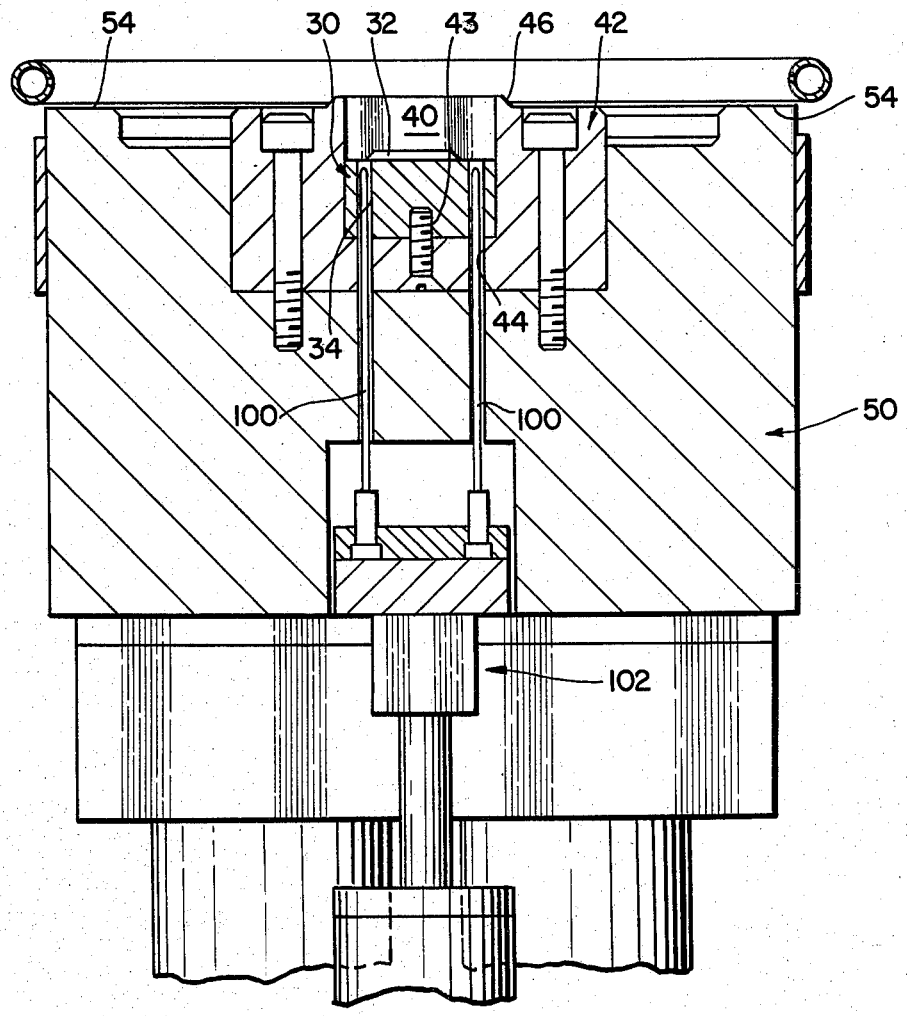

MOLDING OF SUPERPLASTIC METALS

BACKGROUND OF THE INVENTION

This invention relates to a novel process for molding superplastic metals and apparatus useful in carrying out said process.

Superplastic metals are known in the art as materials that provide some of the advantages of both metals and plastics. Although there are a substantial number of metal alloys that exhibit superplastic character under some conditions, some superplastic metals are readily susceptible to commercial exploitation as such. Among these are those such as the zinc alloys available commercially from New Jersey Zinc Company and others. In this invention, the term superplastic metal is limited to those useful in molding operations in which the superplastic properties are utilized. It has been known to mold various articles from such alloys, and it has been particularly advantageous to mold complex forms from such alloys. Thus, for example, such objects as print wheels and metal molds to be used in subsequent injection molding of plastics are known uses for superplastic alloys.

One relatively undesirable feature of the superplastic alloys has been the time required for the molding cycle. This molding cycle time reflects the fact that superplastic materials exhibit substantial strain rate sensitivity and must be formed at carefully controlled rates. Even after the molded item is formed, it is important to exert extreme care in getting it out of the mold. For example, in U.S. Pat. No. 3,578,511, heating the superplastic metal above the critical superplastic forming temperature is recommended as a way to impart a molded article sufficient increased strength to enable its immediate removal from the die in which it has been formed. However, the necessity of heating the metal above the molding temperature is itself a time-consuming and an energy-consuming procedure.

Hence it has remained a problem to obtain rapid economic cycling of molding operations in which articles of superplastic metals are formed.

SUMMARY OF THE INVENTION

A principal object of this invention is to provide an improved process for molding superplastic metals.

A further object of the invention is to provide novel apparatus useful in molding superplastic metals.

Another object of the invention is to provide a process for molding superplastic metals, characterized by a relatively short period of time in the mold.

Other objects of the invention will be obvious to those skilled in the art on their reading of this disclosure.

The above objects have been substantially achieved by utilizing the good heat transfer properties and superplastic properties of the metals to achieve a quicker, yet entirely safe, ejection of molded items from the mold.

It has been found that, if a sufficiently high velocity is imparted to ejector pins, a superplastic metal can be ejected rapidly from the mold without damage even while it remains in the superplastic state. The ejector pins must have a velocity such that impact raises the yield strength, say about 150,000 psig of the superplastic material to a point where plastic deformation is avoided. Also, of course the ejector pins must have sufficient force to overcome retentive forces between the mold and the molded object. In practice, the ejector pins can be conveniently operated at 40 to 100 inch per inch per second, that is the speed can be, conveniently, equivalent to 40 to 100 inches per second for each inch of vertical thickness of the molded part. Both upper and lower limits will vary with the elastic range of different alloys.

In summary, the velocity must be rapid enough to cause the impacted superplastic material to reach a high yield stress under the conditions of impact. The velocity of impact must not be high enough to exceed the elastic limit of the superplastic material, and the force of the velocity on the still-hot superplastic article must be sufficient to overcome whatever frictional forces or sticking is present between the mold and the superplastic article being rejected.

BRIEF DESCRIPTION OF THE DRAWINGS

FIG. 1 is a plan using a typical pattern block carrying a male pattern.

FIG. 2 shows the pattern block of FIGS. 1 and 2 fastened in a retainer block and bolted to a base ring.

Referring to FIG. 1, a generally rectangular block 30 comprises an elevated portion 32 which forms pattern means to shape a superplastic metal to be forced over the pattern face 31 of block 30. For small ejector pin holes 34, are spaced about the perimeter of block 30.

Block 30, which is, as shown in FIG. 2, bolted into a cavity 40 in a retainer block 42 with bolt 43. Retainer block 42 comprises channels 44 communicating with cavity holes 34 for accomodating ejector pins which are to be used in ejection of a molded article from cavity 40. Block 42 also comprises a raised shoulder 46 about the periphery of cavity 40. Retainer block 42 is itself nested into a recess within a base ring 50 which also comprises an annular rim 54 about the upper edge thereof. As seen in FIGS. 3, and 4, a rectangular superplastic metal blank 60 to be molded rests on shoulder 46 beneath before a rectangular piston guiding cylinder 70 (see FIG. 4). Cylinder 70, comprising a central channel 72 is lowered around superplastic zinc alloy blank 60 and also forms a path through which piston 80 (which has a generally rectangular crossection approximately the same as blank 60 descends. Piston 80 pushes blank 60 downwardly towards and into the mold formed by piston 80, pattern block 30 and retainer block 42. The downward stroke of piston 80 is shown, where terminated, in FIG. 5. (Piston 80 comprises internal electrical heating means. The means by which this heating means is placed in the piston is well known in the art and is not shown in the drawings.) It is noted that the blank is transformed into a shaped article 90 which comprises an indentation 92 (which itself is to function as a mold cavity for injection molding procedures with thermoplastics,) and a stem portion 94 (which will eventually serve as a means to facilitate the mounting of article 90 in an injection molding machine). In the process of the invention, however stem 94 serves an important and a more immediate important function;

Figure 3:
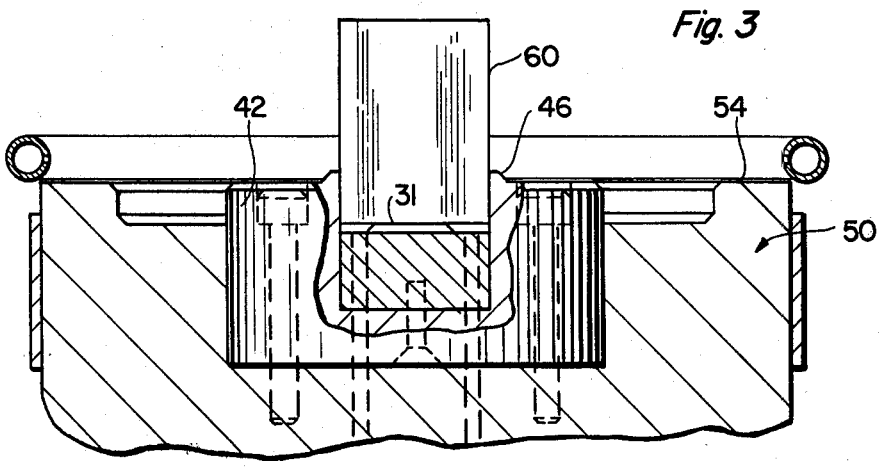
FIGS. 3–7 illustrate various steps in processing a superplastic material into a finished molded product.
Figure 4:
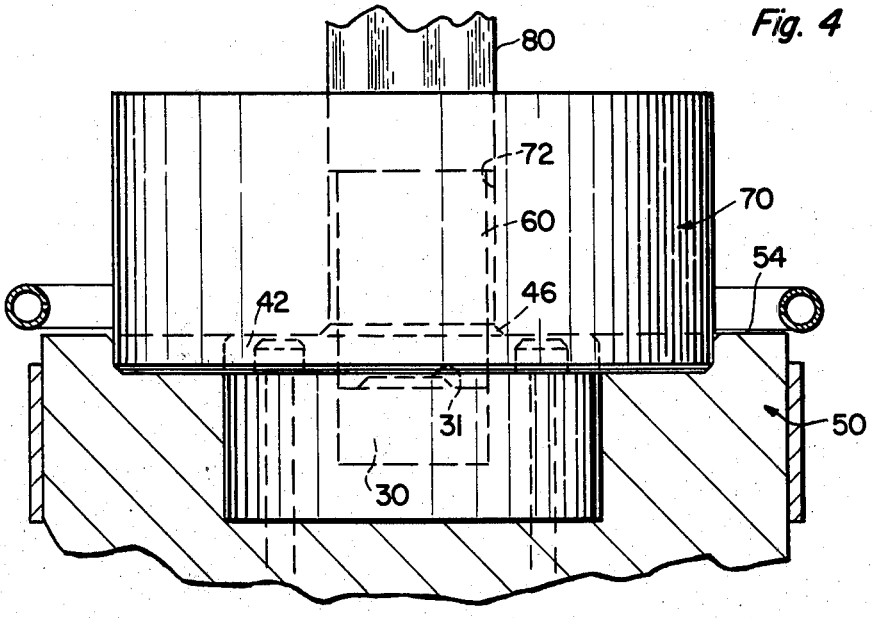
Figure 5:
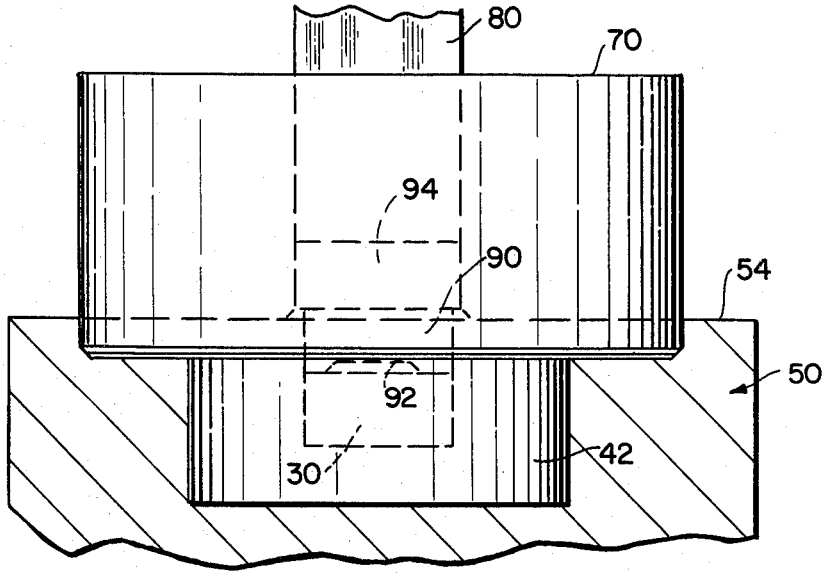
Figure 6:
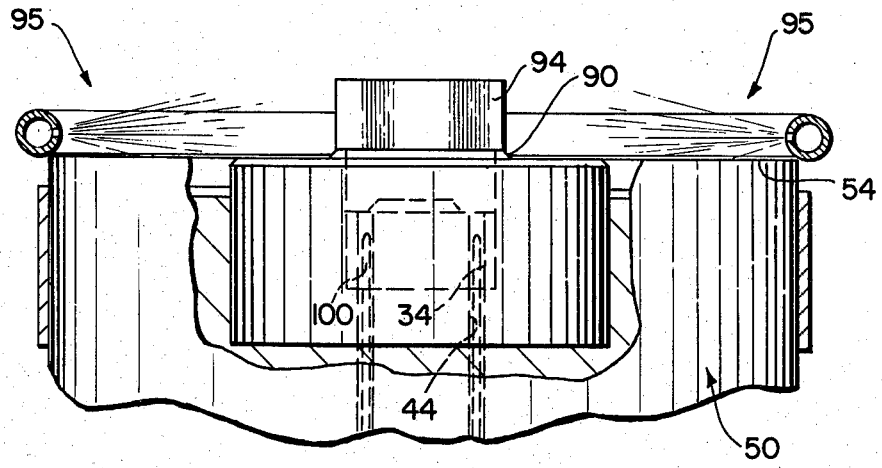

When cylinder 70 and piston 80 are withdrawn, stem 94 is left exposed to an jet-air-cooling from an annular cooling means schematically indicated at 95 in FIG. 6.

This air cooling feature imparts a thermal contraction to the shaped article of zinc-alloy superplastic. This cooling is carried out as soon as stem is exposed, i. e. without raising the temperature above any critical temperature at which the superplastic characteristic, i.e. the strain-rate sensitivity, of a superplastic metal is destroyed. Moreover, the cooling is terminated, for the illustrative embodiment where the mold is about one inch square, after about 10 seconds. This is a time such that the strain rate sensitivity of the block is still high, but before the cooling effect becomes so great that retainer block 42 becomes so substantially effected by cooling that it tends to shrink around the molded article 90. The net effect of the cooling is to reduce the tightness of the more substantially cooled molded article 90 within the still relatively hot retainer block 42.

Figure 7:
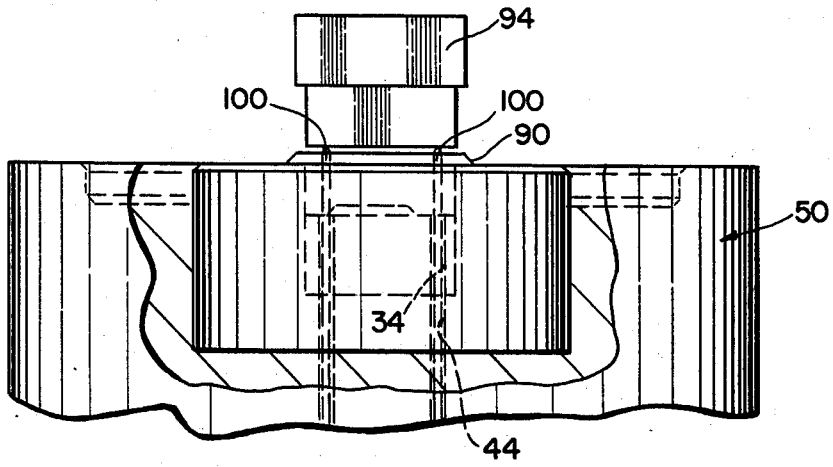

At this point, as shown in FIG. 7, ejector pins 100, which are only about 0.1 inches in diameter, are activated to rise up through channels 44 and 34 and eject the molded product from the mold. The pins themselves are operated by a conventional pneumatic ram assembly 102 shown in FIG. 1.

Figure 8:
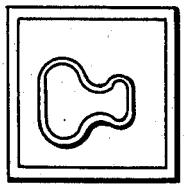
FIGS. 8 and 9 illustrate the molded product.
Figure 9:
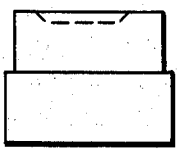

FIGS. 8 and 9 are plan and elevation views of a typical molded part as it is removed from the mold.

Figure 10:
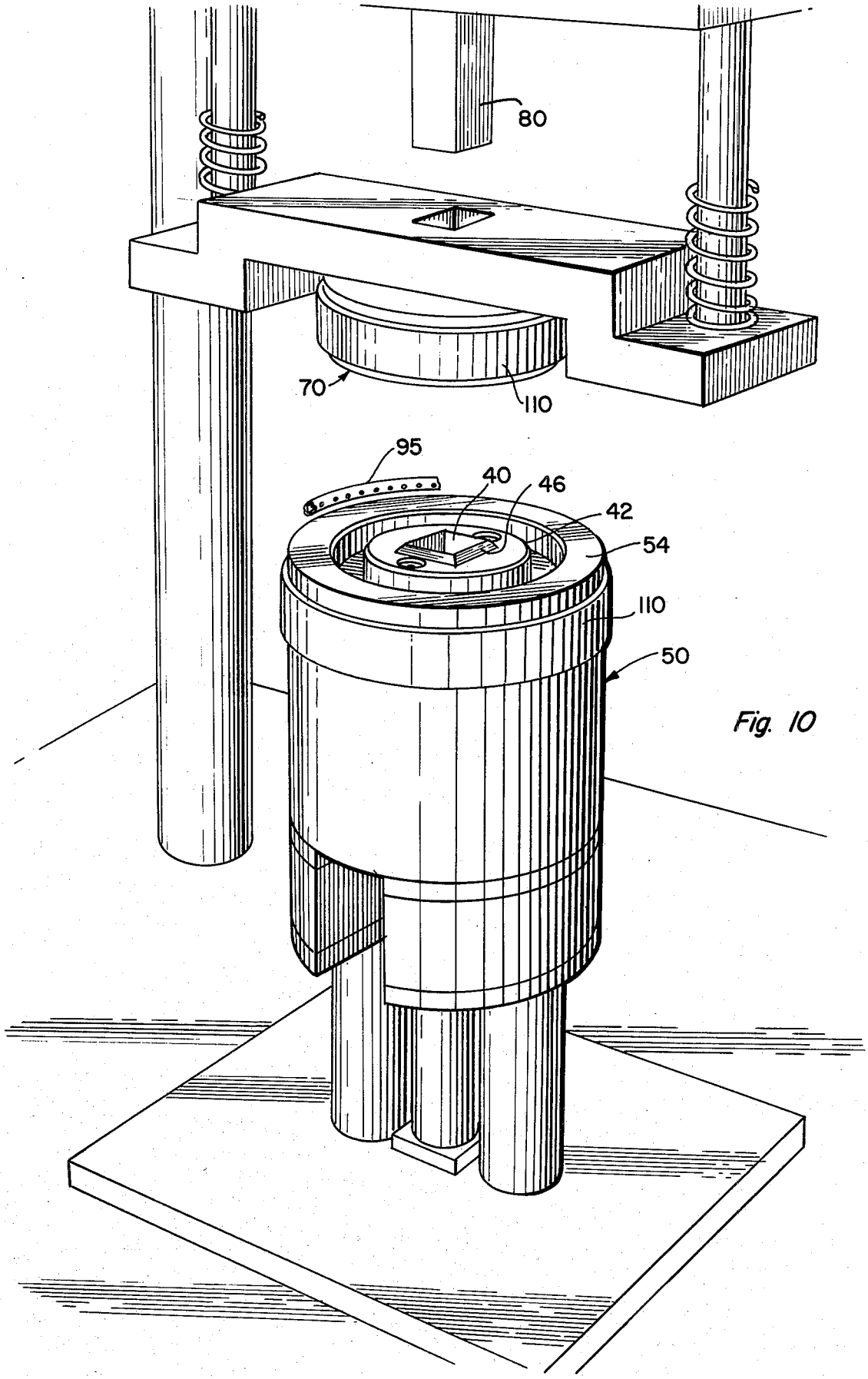
FIG. 10 is a perspective view of pertinent portions of the apparatus in which the process depicted in FIGS. 4–7 is advantageously carried out.

FIG. 10 illustrates schematically, and in perspective, the apparatus of the invention with emphasis on the importance of heat control. For example, it is to be noted that electrical band heaters 110 are placed on the exterior of both the base ring 50 and cylinder 70. These heaters are used to transmit heat to the apparatus, preheating it, typically to the 510° F.–520° F. range before inserting the blank (which itself is advantageously preheated to about 400°–450° F.).

In a typical process, but one which is relatively demanding because of the depth of the part being molded, the pressing cycle of piston on blank would be as follows:

1. Place preheated blank face down on apparatus.
2. Close press and allow 2–3 minutes for temperature to stabilize.
3. Verify blank temperature is above 480° F.
4. Bring piston to 1 ton, hold for 30 seconds, and degas.
5. Bring piston to 2 tons, hold for 30 seconds and degas.
6. Bring piston to 3 tons, hold for 30 seconds and degas.
7. Bring piston to 5 tons, and hold for 30 seconds, and degas.
8. Bring piston to 7 tons, hold for 1 minute, and degas.
9. Bring piston to 9 tons, hold for 1 minute, and degas.
10. Let pressure off press and cool as described herein above before ejecting.

Degassing is achieved by allowing the piston to return to atmospheric pressure.

Even though the primary problem faced by the art has been the removal of the molded superplastic article without distorting it, it is important that the ejection pins be moved rapidly. Gentle movement will result in deformation of the article 90 and only rapid movement, preferable at least about 50 inches per second for the illustrated embodiment, will assure the removal. Such rapid movement, apparently, is too fast for the metal to deform when it is in its strain-rate-sensitive condition.

Although, there are a number of superplastic alloys available on the market place, the present invention is believed to be particularly useful in processing such superplastic zinc alloys as are available under the trademark "SUPER Z" from the G & W Natural Resources Group (the old New Jersey Zinc Company) e.g. SUPER Z 200, 300 and 400.

An impact velocity of about 50 inches per second is adequate to avoid deformation of the article. The strain-rate on a material having a yield strength of about 150,000 psi will be 100 inch per second. This is sufficiently high to achieve the intended result, i.e. to avoid distortion of the molded article by the ejector pins. The ejector pins also must have sufficient force behind them to overcome the retention forces between the molded article and the mold itself. A 5–10 second air cooling cycle markedly aids the reduction of this force.

It is to be particularly noted that the use of a non-circular (e.g. generally rectangular, corresponding to that of block 30 and blank 60) piston 90 is greatly facilitated by the present process, because the perimeter of the article formed and ejected from the press is not minimized when the above-described cooling step is made. In practice, it is best to round off the corners of these generally rectangular objects. Use of a non-circular piston is highly advantageous because it allows the manufacture of molded articles, say articles which are to be mounted for use as molds in conventional thermoplastic ejection-molding equipment, to form them in the shape they will ultimately be used. This, for example, can eliminate about 15 minutes of milling per molded article. Thus the time required in preparing molded articles is reduced even further as a result of the process of the invention.

It is desirable to assure a selective, predictable, readly release characteristic between the piston 80 and cylinder 70 and the upper portion 94 of the molded product. An entirely suitable release facilitating composition is a colloidial bronze-based paint composition. One such composition is available from the NEVER-SEEZ Corporation of Broadview, Ill.

It is also to be understood that the following claims are intended to cover all of the generic and specific features of the invention herein described and all statements of the scope of the invention which might be said to fall therebetween.

What is claimed is:

1. In a process for molding of a superplastic metal, wherein said metal is formed under heat and pressure in a mold into a molded article which article is thereupon removed from the mold, the improvement comprising the steps of A. opening the mold, after the forming step is complete, to expose a portion of said article, B. applying a cooling medium to said exposed portion of said article for a period sufficient to shrink said article to the extent there is a less tight relationship between walls of said article which are still within said mold and said mold, said cooling being terminated before said mold is itself substantially affected by said cooling.

C. impacting said article with means to overcome any retentive forces still existing between said mold and the said walls of said article which were left within said mold and knock said article out of said mold, said impact being at a velocity high enough to cause the impacted superplastic material to reach a yield strength of about 150,000 psi but which does not exceed the elastic limit of the superplastic material.

2. A process as defined in claim 1 wherein said impact is at least 40 inches per second for each inch of that average dimension of the molded article which is parallel to the direction of impact.

3. A process as defined in claim 1 or 2 wherein said superplastic metal is a zinc-alloy based superplastic.

4. A process as defined in claim 1 wherein said cooling medium is applied by air-cooling from an air ring mounted about said exposed portion of said article.

5. A process as defined in claims 1 or 4 wherein said exposed portion of said article is rectangular in shape.

* * * * *

UNITED STATES PATENT AND TRADEMARK OFFICE

CERTIFICATE OF CORRECTION

PATENT NO. : 4,299,111

DATED : November 10, 1981

INVENTOR(S) : James E. Fayal, Joseph A. Morrone, III

It is certified that error appears in the above-identified patent and that said Letters Patent are hereby corrected as shown below:

Cover sheet, Assignee: change "Vallen" to --Valley--.

column 1, line 66: insert -- , -- after "course".

column 2, line 37: change "accomodating" to -- accommodating-- column 2, line 50: insert -- ) -- after "descends."

Column 2, line 65: "function;" to -- function. --.

column 2, line 67: change "to an" to -- to a -- .

column 3, line 12: change "effected" to -- affected -- .

column 4, line 31: change "readly" to -- ready- --.

column 4, line 57: change "cooling." to -- cooling, --.

Signed and Sealed this

*Twenty-third* Day of *March 1982*

[SEAL]

*Attest:*

GERALD J. MOSSINGHOFF

*Attesting Officer*

*Commissioner of Patents and Trademarks*